US006734422B2

(12) United States Patent
Haney et al.

(10) Patent No.: US 6,734,422 B2
(45) Date of Patent: May 11, 2004

(54) PORTABLE OUTGAS DETECTION APPARATUS

(75) Inventors: Steven Julian Haney, Tracy, CA (US); Michael E. Malinowski, Livermore, CA (US)

(73) Assignee: EUV LLC, Santa Clara, CA (US)

( * ) Notice: Subject to any disclaimer, the term of this patent is extended or adjusted under 35 U.S.C. 154(b) by 458 days.

(21) Appl. No.: 09/816,307

(22) Filed: Mar. 21, 2001

(65) Prior Publication Data

US 2002/0134934 A1 Sep. 26, 2002

(51) Int. Cl.[7] ..... H01J 49/04
(52) U.S. Cl. ..... 250/288; 250/281; 250/282
(58) Field of Search ..... 250/288, 281, 250/282

(56) References Cited

U.S. PATENT DOCUMENTS 3,700,893 A * 10/1972 Seidenberg et al.
3,956,923 A * 5/1976 Young et al. ..... 73/49.3
4,260,886 A * 4/1981 Grilletto et al. ..... 250/288
4,459,844 A 7/1984 Burkhart
4,820,920 A * 4/1989 Bather ..... 250/282
5,076,699 A 12/1991 Ryan et al.
5,134,877 A 8/1992 Gilles et al.
5,235,845 A 8/1993 Ito et al.
5,313,061 A * 5/1994 Drew et al. ..... 250/281
5,404,747 A 4/1995 Johnston et al.
5,889,199 A 3/1999 Wong et al.

* cited by examiner

*Primary Examiner*—Jack Berman
(74) *Attorney, Agent, or Firm*—Fliesler Meyer LLP

(57) ABSTRACT

A portable device for detecting surface outgas contaminants of an article includes: (i) a portable housing that has a chamber which is in communication with a port that is adapted to be sealably attached to a surface of the article; (ii) a mass spectrometer that is coupled to the chamber for analyzing gaseous materials in the chamber; and (iii) means for generating a vacuum within the chamber thereby drawing outgas contaminants from the surface of the article into the chamber for analysis by the mass spectrometer. By performing a mass spectrometric analysis of the surface of interest and comparing the data with mass spectrometric data ascertained with the device from a clean surface, the type and amount of outgas contaminants, if any, can be determined.

12 Claims, 2 Drawing Sheets

PORTABLE OUTGAS DETECTION APPARATUS

This invention was made with Government support under Contract No. DE-AC04-94AL85000 awarded by the U.S. Department of Energy to Sandia Corporation. The Government has certain rights to the invention.

FIELD OF THE INVENTION

The invention relates to a portable detector for measuring outgas that is emitted from large structures or assemblies and particularly to a portable detector that employs a mass spectrometer for obtaining qualitative and quantitative information regarding the outgas.

BACKGROUND OF THE INVENTION

The ability to produce high quality microelectronic devices and reduce yield losses is strongly dependent upon maintaining the surfaces of various photolithographic components substantially contaminant and defect-free. This is particularly true as design rules drive integrated circuits to finer feature size. Contaminants can manifest as outgases from assembled parts. For small assembled structures one method of detecting outgas is to place the structure in a vacuum chamber and analyze the gases that may be present. However, with large assembled structures this procedure is not practical. Moreover, while the individual components of a large assembled structure can be tested separately prior to assembly, there is a need to test the assembled structure itself as well as to perform the analysis at the site where the assembled structure is to be employed.

SUMMARY OF THE INVENTION

The invention is directed to a portable apparatus and process for detecting surface contamination.

In one embodiment, the invention is directed to an apparatus for detecting outgas contaminants generated from an article that includes:

- a portable housing that has a chamber which is in communication with a port that is adapted to be sealably attached to a surface of the article;
- a mass spectrometer that is coupled to the chamber for analyzing gaseous materials in the chamber; and
- means for generating a vacuum within the chamber thereby drawing outgas contaminants from the surface of the article into the chamber for analysis by the mass spectrometer.

In another embodiment, the invention is directed to a method of analyzing gas contaminants that are generated from an article that is located within an environment, said method including the steps of:

(1) performing a mass spectrometric analysis of the environment;

(2) performing a mass spectrometric analysis of gas emanating from the article; and (3) comparing the analyses from steps 1 and 2 to determine what gas contaminants, if any, are generated from the article.

DETAILED DESCRIPTION OF THE INVENTION

Figure 1:
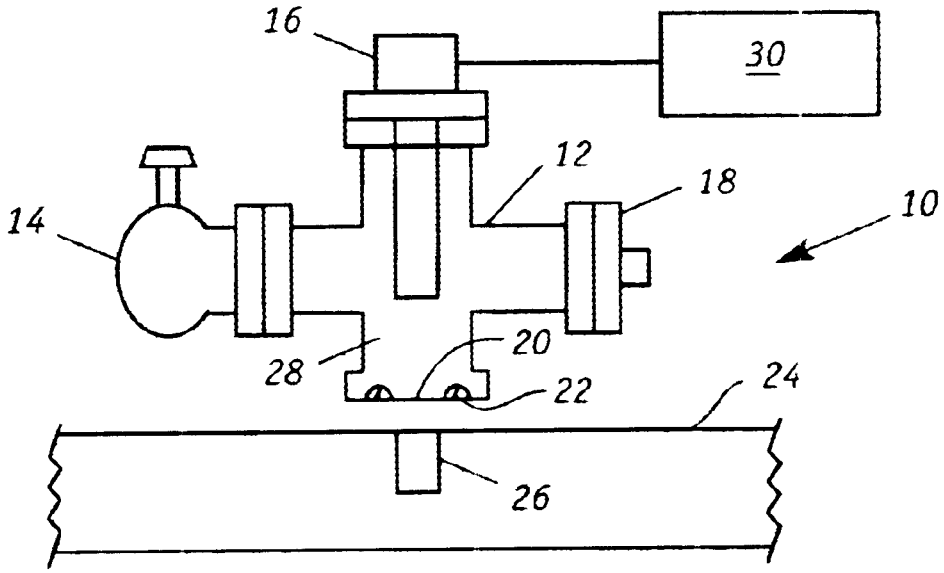
FIGS. 1 and 2 illustrate embodiments of the portable outgas detection apparatus.

FIG. 1 illustrates one embodiment of the portable outgas detection apparatus 10 which includes of a four-sided vacuum cross 12 which defines a chamber 28. A mass spectrometer 16, pressure gauge 18, and vacuum pump 14 are mounted on three branches of the vacuum cross 12. The open orifice of the lower branch has an o-ring 22 that seals against a surface to be tested. The apparatus further includes data processor 30 that generates data, e.g., mass spectrographs. The data processor can comprise a computer and other electronic devices known in the art.

In operation, a background mass spectrum is first taken from a known clean area of the test surface using the apparatus. This can be done by placing the open orifice over the known clean surface and activating the vacuum pump to create a sufficient vacuum within the chamber of the apparatus for mass spectrometric analysis. The vacuum will draw normal background air into the chamber for analysis. Typically the vacuum pump should be sized to maintain a pressure within the chamber that is suitable for mass spectrometer analysis which is typically less than 0.1 mTorr.

Subsequently, one or more spectra are taken from surface area of interest. For example, as shown in FIG. 1, a threaded hole 26 or other feature defined on article 24 can be the source of outgas from residual materials within the hole. The open orifice is placed over hole 26 and a mass spectrometric analysis is performed. By comparing the subsequent mass spectrum with the mass spectrum of the clean background, it is possible to determine the specific types and amounts of contaminants present. In this fashion, the cleanliness and therefore the cleaning procedure can be verified.

Figure 2:
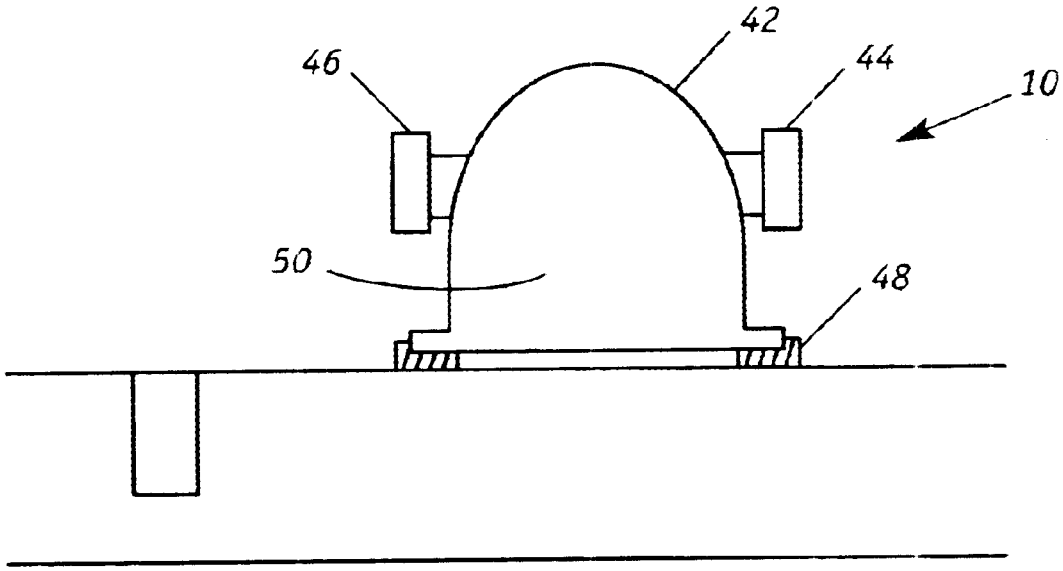

FIG. 2 illustrates another embodiment of the portable outgas detection apparatus 40 which has a bell shaped housing 42 that defines chamber 50. The apparatus includes plurality of flanged ports 44, 46 to which the mass spectrometer (not shown), vacuum pump (not shown), and pressure gauge (not shown) can be coupled. The apparatus has a lower port that is adapted to rest on top of a surface to be tested. The port includes a suitable seal 48 such as an o-ring.

The two apparatus shown in FIGS. 1 and 2 are particularly suited for testing articles with flat surfaces. In the case where the surface is not flat, these apparatus can be easily modified by changing the contour of the port to match that of the surface of interest.

To demonstrate the effectiveness of the present invention, a device similar to that shown in FIG. 1 was constructed and tested. The device was employed to measure the presence of possible contaminants from metal surfaces that included blind threaded holes. The device included (1) a vacuum cross from MDC Vacuum Products Corp., Hayward Calif. (model 405034), (2) a mass spectrometer including software from Stanford Research Systems, Sunnyvale Calif. (model RGA 200), and (3) a turbo pump from Pfeiffer Vacuum, Nashua N.H. (model TMV 180 HM). A standard laptop computer was used to control and operate the device.

Figure 3:
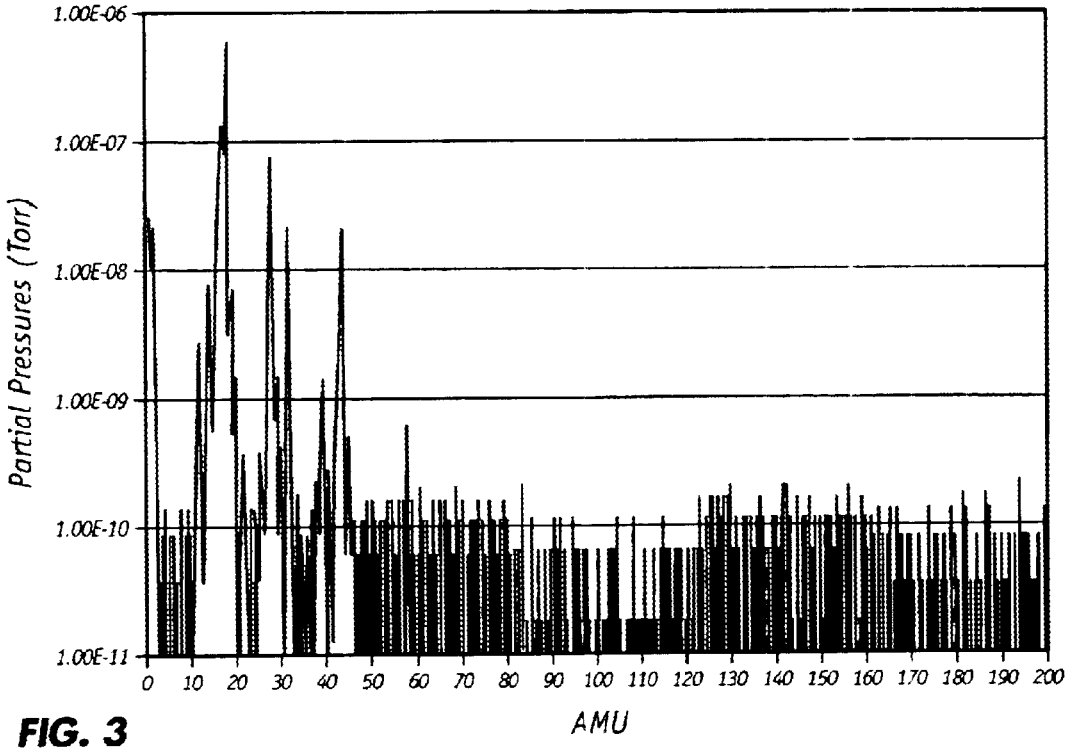
FIGS. 3 and 4 are mass spectrometer outputs from background and outgas measurements, respectively.
Figure 4:
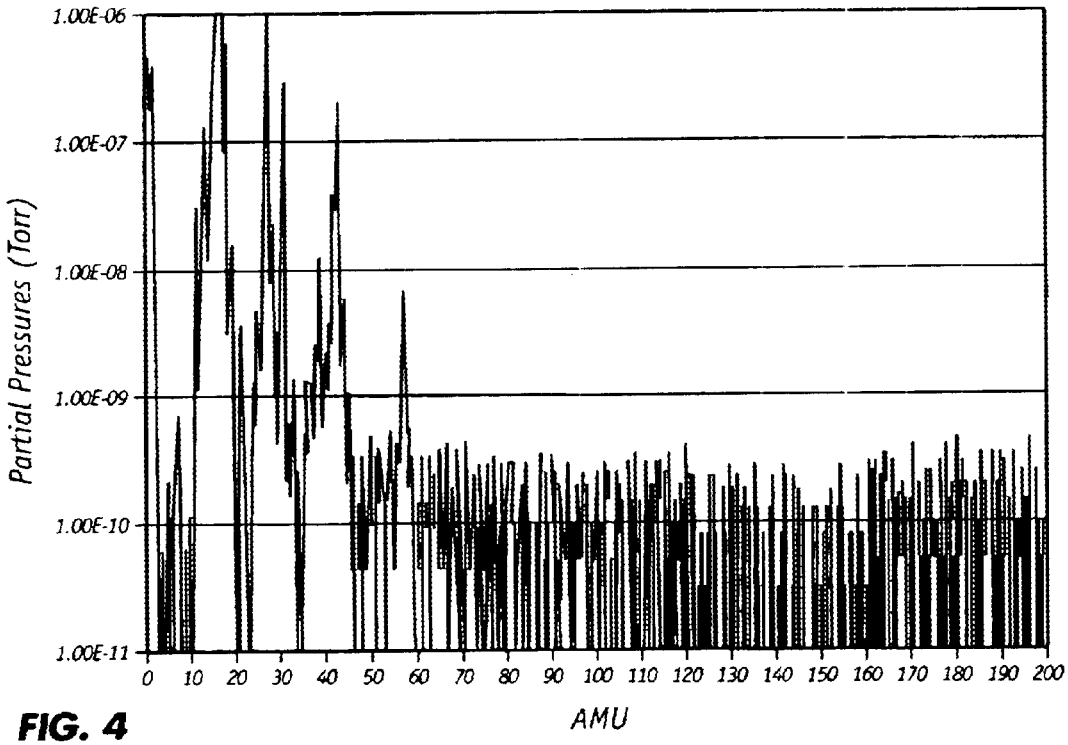

FIG. 3 is the mass spectrometer output of the background or environment and FIG. 4 is the mass spectrometer output from a surface of the metal surface with the blind threaded holes. As is apparent, the latter shows a generally higher measurements throughout. Although not done for this demonstration, analysis of each output and comparison of the results will yield information regarding the type and quantity of chemical contaminants present on the surface being measured.

As is apparent, one advantage of the inventive device is its simplicity. The portable device does not require means for separating one or more gas components from the gaseous material in the chamber prior to being analyzed in the mass spectrometer. Specifically, outgas to be analyzed does not travel through a separation chamber where one or more gaseous components are removed before the sample enters the spectrometer.

The present invention can be employed to analyze any gaseous substance that can detected with a mass spectrometer. While a preferred method of use is to detect outgas which is generated by foreign or contaminant material on any article, it is understood that the method can also be employed to measure gases that are normal to a particular device as well.

An apparatus has been developed to allow vacuum outgas test qualification of assemblies with large, flat surfaces that include blind or through threaded holes. The apparatus is used on assemblies that are too large to be qualified in any of the existing vacuum outgas test chambers. The system is portable and can be adapted to various surface configurations by shaping the interface port.

Although only preferred embodiments of the invention are specifically disclosed and described above, it will be appreciated that many modifications and variations of the present invention are possible in light of the above teachings and within the purview of the appended claims without departing from the spirit and intended scope of the invention.

What is claimed is:

1. An apparatus for detecting outgas contaminants generated from an article that comprises:

a portable housing that has a chamber which is in communication with a port that is sealably attached to a surface of the article;

a mass spectrometer that is coupled to the chamber for analyzing gaseous materials in the chamber; and means for generating a vacuum within the chamber to draw outgas contaminants from the surface of the article into the chamber, wherein the outgas contaminants are transferred from the chamber to the mass spectrometer for analysis.

2. The apparatus of claim 1 wherein the mass spectrometer has an entrance port that is in direct gaseous communication with the chamber.

3. The apparatus of claim 1 wherein the means for generating a vacuum comprises a pump.

4. The apparatus of claim 1 wherein the port includes a nozzle having a polymer lining sealably attached the surface of the article.

5. The apparatus of claim 1 wherein the mass spectrometer generates analysis data for the outgas contaminants and the apparatus includes means for comparing said analysis data for the outgas contaminants to analysis data for a background gas sample.

6. A method of analyzing gas contaminants that are generated from an article, said method comprising the steps of (1) attaching a portable chamber sealably to said article;

(2) performing a mass spectrometric analysis of the atmospheric cases external to the chamber;

(3) performing a mass spectrometric analysis of gas emanating from the article, and (4) comparing the analyses from steps 2 and 3 to determine what gas contaminants, if any, are generated from the article.

7. The method of claim 6 wherein step 3 is performed with an apparatus that comprises:

a portable housing that has a chamber which is in communication with a port that is sealably attached to a surface of the article;

a mass spectrometer that is coupled to the chamber for analyzing gaseous materials in the chamber; and means for generating a vacuum within the chamber to draw outgas contaminants from the surface of the article into the chamber; and transferring the outgas contaminants from the chamber to the mass spectrometer for analysis.

8. The method of claim 7 wherein the mass spectrometer has an entrance port that is in direct gaseous communication with the chamber.

9. The method of claim 7 wherein the means for generating a vacuum comprises a pump.

10. The method of claim 7 herein the port includes a nozzle having a polymer lining sealably attached the surface of the article.

11. The method of claim 7 wherein the mass spectrometer generates analysis data for the outgas contaminants and the apparatus includes means for comparing said analysis data for the outgas contaminants to analysis data for a background gas sample.

12. The method of claim 7 wherein step 3 comprises:

(1) positioning the port on a surface of the article;

(2) creating a vacuum within the chamber whereby gas from the surface is drawn into the chamber; and (3) analyzing the gas in the chamber with the mass spectrometer.

* * * * *